US010054379B2

(12) United States Patent
Lammers et al.

(10) Patent No.: US 10,054,379 B2
(45) Date of Patent: Aug. 21, 2018

(54) SEMI-AUTOMATIC RIFLE AND RETROFIT KIT FOR A SEMI-AUTOMATIC RIFLE

(71) Applicant: LOSOK-OSPREY HOLDINGS LLC, Delaware, OH (US)

(72) Inventors: Mark Lammers, Delaware, OH (US); William Rhoades, Columbus, OH (US)

(73) Assignee: LOSOK-OSPREY HOLDINGS LLC, Delaware, OH (US)

( * ) Notice: Subject to any disclaimer, the term of this patent is extended or adjusted under 35 U.S.C. 154(b) by 0 days.

(21) Appl. No.: 15/503,372

(22) PCT Filed: Aug. 11, 2015

(86) PCT No.: PCT/US2015/044738
§ 371 (c)(1),
(2) Date: Feb. 10, 2017

(87) PCT Pub. No.: WO2016/025534
PCT Pub. Date: Feb. 18, 2016

(65) Prior Publication Data

US 2017/0241724 A1 Aug. 24, 2017

Related U.S. Application Data

(60) Provisional application No. 62/035,564, filed on Aug. 11, 2014, provisional application No. 62/072,589, filed on Oct. 30, 2014.

(51) Int. Cl.
*F41A 5/26* (2006.01)
*F41A 15/14* (2006.01)
(Continued)

(52) U.S. Cl.
CPC ..... *F41A 5/26* (2013.01); *F41A 3/12* (2013.01); *F41A 3/66* (2013.01); *F41A 15/14* (2013.01);
(Continued)

(58) Field of Classification Search
CPC .... F41A 5/26; F41A 15/14; F41A 3/66; F41A 19/10; F41A 17/64; F41A 3/12; F41G 11/003; F41C 23/16
(Continued)

(56) References Cited

U.S. PATENT DOCUMENTS 1,892,141 A * 12/1932 Garand ..... F41A 3/26 42/1.02
2,389,631 A * 11/1945 Moore ..... F41A 3/32 42/16
(Continued)

FOREIGN PATENT DOCUMENTS

WO 2016025534 2/2016

OTHER PUBLICATIONS

International Search Report and Written Opinion for corresponding PCT application No. PCT/US2015/044738 dated Jan. 8, 2016.

*Primary Examiner* — John Cooper
(74) *Attorney, Agent, or Firm* — Polsinelli PC

(57) ABSTRACT

Semi-automatic rifle including a free floating barrel with a muzzle located at a distal end and an engagement mechanism at a proximal end. The barrel has a length measured from the proximal end to the distal end. A receiver can be configured to couple the engagement mechanism of the barrel and a bolt at least partially rotatably mounted relative to the receiver. A gas cylinder system being coupled to the barrel substantially close to the muzzle and including an operating rod. A trigger assembly coupled to the receiver to receive at least a portion of the operating rod and a bridge coupled to the trigger assembly. A fire control located substantially within the trigger assembly and configured to actuate the bolt so as to eject a cartridge and load a subsequent cartridge from a clip.

16 Claims, 12 Drawing Sheets

(51) Int. Cl.

| | |
|---|---|
| ***F41G 11/00*** | (2006.01) |
| ***F41C 23/16*** | (2006.01) |
| ***F41C 23/04*** | (2006.01) |
| ***F41A 3/66*** | (2006.01) |
| ***F41A 19/10*** | (2006.01) |
| ***F41A 17/64*** | (2006.01) |
| ***F41A 3/12*** | (2006.01) |

(52) U.S. Cl.
CPC ..... *F41A 17/64* (2013.01); *F41A 19/10* (2013.01); *F41C 23/04* (2013.01); *F41C 23/16* (2013.01); *F41G 11/003* (2013.01)

(58) Field of Classification Search
USPC ..... 89/193, 192
See application file for complete search history.

(56) References Cited

U.S. PATENT DOCUMENTS

| | | | | |
|---|---|---|---|---|
| 3,256,632 | A | 6/1966 | Beretta et al. | |
| 3,776,095 | A * | 12/1973 | Atchisson | F41A 11/02 42/16 |
| 4,833,970 | A * | 5/1989 | Wilhelm | F41A 19/33 89/141 |
| 4,930,399 | A * | 6/1990 | Trevor, Jr. | F41A 3/46 89/185 |
| H000926 | H | 6/1991 | Mahtook | |
| 5,726,377 | A | 3/1998 | Harris et al. | |
| 7,739,939 | B2 * | 6/2010 | Adams | F41A 5/26 89/191.01 |
| 8,210,089 | B2 * | 7/2012 | Brown | F41A 5/18 89/191.02 |
| 8,800,423 | B1 * | 8/2014 | Lammers | F41A 5/18 89/191.01 |
| 8,931,393 | B1 * | 1/2015 | Vincent | F41A 19/10 42/70.06 |
| 9,091,499 | B2 * | 7/2015 | Overstreet | F41A 3/68 |
| 9,194,639 | B1 * | 11/2015 | Malheiros | F41A 19/32 |
| 9,404,694 | B2 * | 8/2016 | Hochstrate | F41A 3/26 |
| 9,772,150 | B2 * | 9/2017 | Gomez | F41A 3/66 |
| 9,927,198 | B2 * | 3/2018 | Geissele | F41A 19/10 |
| 2007/0180984 | A1 | 8/2007 | Huther | |
| 2007/0199435 | A1 | 8/2007 | Hochstrate et al. | |
| 2010/0236394 | A1 * | 9/2010 | Gomez | F41A 17/42 89/138 |
| 2010/0281733 | A1 | 11/2010 | Constant et al. | |
| 2011/0099868 | A1 * | 5/2011 | Lammers | F41C 7/00 42/6 |
| 2011/0277623 | A1 | 11/2011 | Adolphsen | |
| 2012/0137563 | A1 | 6/2012 | Ubl et al. | |
| 2012/0279385 | A1 * | 11/2012 | Dieckmann | F41A 5/26 89/193 |
| 2012/0297656 | A1 * | 11/2012 | Langevin | F41A 3/66 42/16 |
| 2014/0068987 | A1 | 3/2014 | Burt | |

* cited by examiner

SEMI-AUTOMATIC RIFLE AND RETROFIT KIT FOR A SEMI-AUTOMATIC RIFLE

CROSS REFERENCE TO RELATED APPLICATIONS

This application is U.S. National Stage Entry of PCT Application No. PCT/US2015/044738, filed Aug. 11, 2015, which claims priority to U.S. Provisional Application No. 62/035,564, filed Aug. 11, 2014, and U.S. Provisional Application No. 62/072,589, filed Oct. 30, 2014, the contents of each are entirely incorporated by reference herein.

FIELD

The present disclosure relates generally to firearms, more particularly to semi-automatic types of rifles.

BACKGROUND

The U.S. "M1" rifle, also known as the M1 Garand rifle, was the main battle rifle of the U.S. military from 1936 to 1957. While considered to be technologically advanced in its time. The gas operating system employed on the M1 utilizes an operating rod that is nearly as long as the barrel and a gas cylinder that is mounted very close to the barrel. In order for the rifle to function properly the operating rod must be bent in a manner to clear the stock.

A clip is a device that is used to store multiple rounds of ammunition together as a unit, ready for insertion into a receptacle of a firearm. This speeds up the process of loading and reloading the firearm because several rounds can be loaded at once, rather than one round being loaded at a time. The M1 rifle is designed to feed ammunition from eight-round en bloc clips. With this design, both the round and the clip are inserted as a unit into a fixed magazine within a magazine well, and the clip is usually ejected or falls from the rifle upon firing or chambering of the last round. The M1 is configured such that rounds are fed from the top of the rifle, through an open receiver top, requiring that any added optics or other accessories be mounted on the side of the receiver.

The M1 rifle also uses an indirect bolt stop mechanism that acts on the operating rod, not the bolt itself. The design of the stock on the M1 rifle employs two hand guards to cover the barrel and the operating rod, and which extends nearly to the muzzle of the rifle.

The M1 rifle, its descendants, the M14 and Losok Valkyr, are all very rugged rifle designs, with several very desirable qualities, like accuracy, dependability, simplicity and ease of use. All of the earlier designs were based on using the well-proven trigger mechanism of the M1 in some form. This, by its nature, limited stock designs and weapon size. The earlier designs all required complex and time consuming machining operations related to this mechanism and its placement in the receiver. The firing pin safety bridge in these designs was an integral part of the receiver, and required extensive and complicated milling or casting techniques to be used to make the part. The earlier designs also used a hand guard system that either attached to the barrel or stock. The earlier designs used either side mounted scopes or machined in rails to mount optics. The nature of the design of the M1 required that the barrel be held down by a barrel band or a larger magazine well, as in the Losok Valkyr rifle could be used to hold the front of the rifle in place. On M1 and descendant designs the forward portion of the operating rod was partially covered by the stock and hand guards but at least partially exposing the rod.

BRIEF DESCRIPTION OF THE DRAWINGS

Further features of the present disclosure will become apparent to those skilled in the art to which the present disclosure relates from reading the following specification with reference to the accompanying drawings, in which.

DETAILED DESCRIPTION

Figure 1:
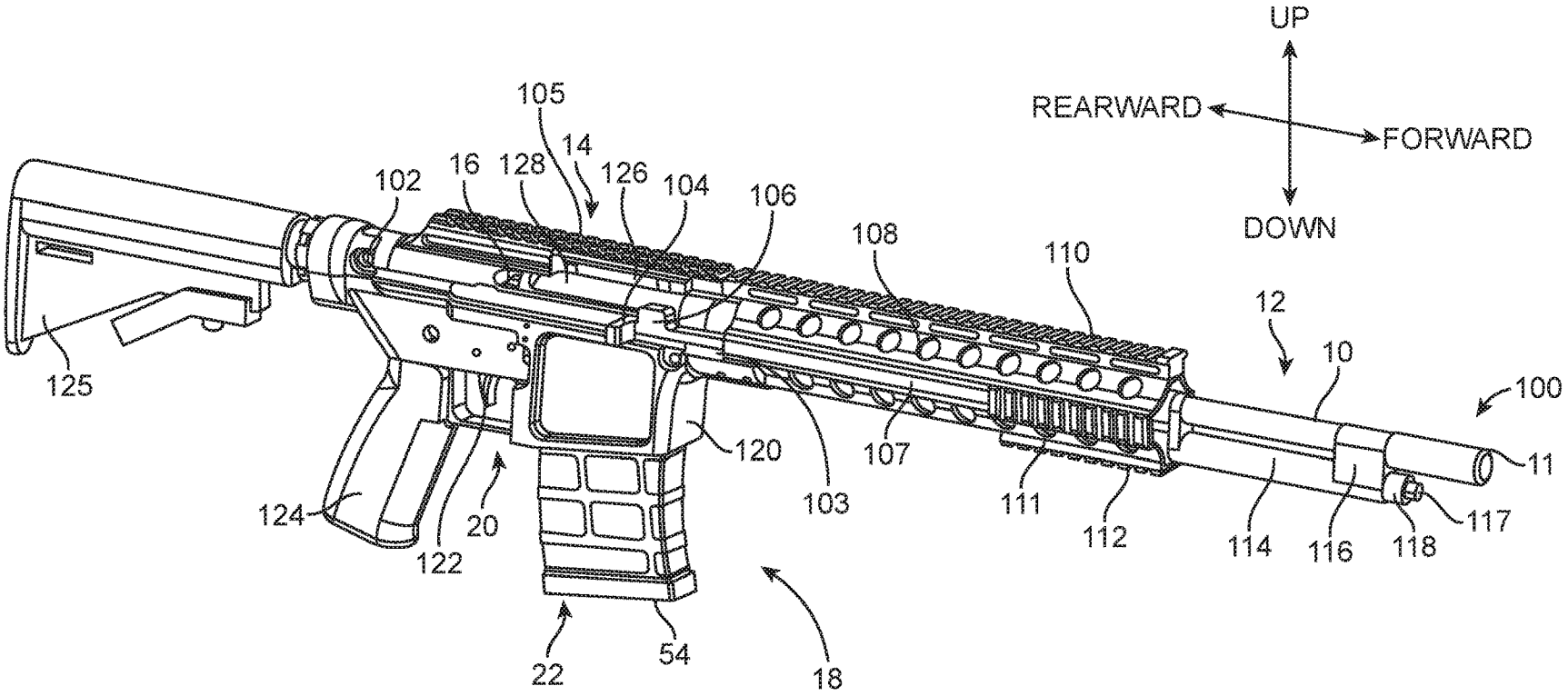
FIG. 1 is a perspective view of a semi-automatic rifle according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The presently disclosed rifle is a significant improvement over the previously discussed rifle designs. The rifle uses an advanced receiver design to facilitate ease of manufacture, assembly and parts replacement.

The current disclosure includes a semi-automatic rifle, of the gas operated, piston driven, air cooled, magazine fed type. The rifle uses a bolt from either the M14 rifle or M1 Garand rifle, Pat. No. 1,892,141, modified in various ways to accommodate differing size ammunition based on caliber. The rifle uses a different type, as compared to the M1 Garand, of receiver, gas cylinder, operating rod, stock, trigger mechanism, firing pin safety, hand guards and sighting system. The rifle also overcomes the shortcomings and complex machine processes of the M1 and its descendant designs, such as the U.S. Model M14 rifle, and the Losok Valkyr rifle, U.S. Pat. No. 8,800,423. The semi-automatic rifle of the present disclosure can be configured and adapted to accept, operate with and discharge rifle cartridges of various calibers and loads. For example, the semi-automatic rifle of the present disclosure can be configured and adapted to utilize cartridges from those similar in size to 5.56×45 mm to those similar in size to the 300 Winchester magnum or even 338 Lapua Magnum. Accordingly, the semi-automatic rifle can be configured and adapted to be compatible with existing or proprietary designed magazines that are also compatible with cartridges of these same various calibers. Moreover, the semi-automatic rifle 100 of the present disclosure can be adapted to provide for select-fire capability.

Further, the semi-automatic rifle can be adapted and configured to operate as a precision rifle, a Squad Auto-Weapon (SAW), a Personal Defense Weapon (PDW) in an addition to a standard battle rifle. When fully assembled the semi-automatic rifle of the present disclosure, without accessories, can weigh less than 3.63 kilograms, have a barrel approximately 25-61 centimeters long but with a 45 centimeter barrel the overall length of the rifle is approximately 90 centimeters. The assembled semi-automatic rifle can weigh between 2.0 and 4.5 kilograms. If a collapsible or foldable stock is coupled to the rifle and set to the folded or collapsed position, the overall length of the rifle in this configuration can be approximately 90 centimeters in length. If a rifle of the present disclosure is configured with a barrel of approximately 40 centimeters and is equipped with a flash suppressor, the overall length of the rifle is approximately 80 centimeters. This same configuration utilizing a foldable or collapsible stock in the folded or collapsed position results in a rifle of the present invention of approximately 63 centimeters in length.

The trigger assembly of the present semi-automatic rifle eliminates the use of the M1 trigger mechanism; instead that of an AR15 style rifle receiver is implemented. The magazine well/trigger housing 34 (shown in FIG. 5) has been relocated onto the trigger assembly 18 and receiver legs 32 (shown in FIG. 5) are eliminated, along with the complex cuts needed to use the M1 trigger mechanism. The firing pin bridge is manufactured as a stand-alone part that is pinned in place in the newly designed trigger assembly which includes trigger (fire control) parts from an AR15 style receiver. The new bridge allows for easy coupling/decloupling improving replaceability, whereas previously the whole receiver would have to be replaced.

The present technology further reduces machine time and core count of casting dies significantly. The bridgeless and legless receiver according to the present disclosure utilizes a screwed-on sight rail to make the interior of the receiver easier to access during manufacture, while having recoil lugs built into the receiver to solidly position the mount. The receiver attaches to trigger assembly using two pins. The butt stock and grip are attached to the trigger assembly. The grip and butt stock can be standard, commercial off-the-shelf (COTS) parts.

The new trigger assembly allows for a specialized stock to be raised to a position in line with the bore of the barrel to reduce recoil and muzzle rise. The reduced recoil and muzzle rise greatly enhance the ability of the shooter to fire an on-target follow up shot more rapidly. The hand guard of the new rifle attaches to the receiver to enhance accuracy and to reduce complexity of manufacture. The guard also covers the forward section of the operating rod to enhance safety and reliability. The hand guard can also include at least one accessory rail configured to receive monopods, bipods, optics, lights, and the like. The barrel features an integral gas cylinder that in one implementation is permanently attached to the barrel by welding or bonding. When a permanent mounting of the gas cylinder is implemented, the construction of the rifle benefits from a faster assembly and ease of manufacture by eliminating complex cuts on the barrel. The present barrel and cylinder design allow for standard muzzle device attachments, such as flash suppressors, silencers and the like. The present rifle is designed to be compatible with a variety of cartridge sizes by swapping barrels, bolts and magazines to accommodate standard currently available magazines.

The present disclosure can also relate to a retrofit kit for existing semi-automatic rifles configured to reuse a barrel group, bolt, and gas cylinder of the existing rifle. The retrofit can include a receiver configured to be coupled to the barrel group. A trigger assembly configured to be coupled to the receiver, and including a firing pin safety bridge. The receiver and trigger assembly can form a bolt receiving space therebetween, such that the bolt receiving space can accommodate the bolt. The firing pin safety bridge can be removably mounted within the trigger assembly.

In at least one embodiment, a receiver can have a threaded end to be coupled to the barrel group and the trigger assembly can have a firing pin safety bridge receiving portion configured to receive a removable firing pin safety bridge.

In at least one embodiment, a receiver can be configured to be coupled to an existing barrel group and a bolt. The receiver can include a front end having a first trigger assembly attachment portion and configured to transfer recoil and a body portion extending rearward from the front end. A rear end formed at an opposite end of the body portion from the front end and having a second trigger assembly attachment portion and configured to transfer recoil. The body portion can have an ejection portion formed therein and configured to permit a spent cartridge to be ejected.

In at least one embodiment, a trigger assembly can be configured to be coupled to a receiver. The trigger assembly can include a front end having a first trigger assembly attachment portion and configured to transfer recoil and a body portion extending rearward from the front end. A rear end formed at an opposite end of the body portion from the front end and having a second trigger assembly attachment portion and configured to transfer recoil. The trigger hosing can also include a firing pin safety bridge receiving portion configured to receive a removable firing pin safety bridge.

FIG. 1 illustrates the general arrangement of a semi-automatic rifle 100, according to an embodiment of the present disclosure. The rifle 100 can include of a plurality of parts grouped together along with each group's respective components. In at least one example, the plurality of parts can be groups that work and function together to facilitate the operation of the rifle 100 as a whole. In particular, the rifle 100 can include a barrel group 12, a receiver group 14, a bolt group 16, a stock group, a trigger group 20, and a magazine group 22. The components of each of these groups will be described in detail herein. While the present disclosure relates to a semi-automatic rifle 100 having a barrel group 12, receiver group 14, bolt group 16, stock group, trigger group 20 and a magazine group 22, a rifle having more or less of the above groups can be implemented without deviating from the present disclosure. Additionally, the each group can contain fewer or additional components to those described below with respect to each group.

The receiver group 14 includes a receiver 105 having threads 154 (shown in FIG. 4) at the front for attachment of the barrel group 12 and hand guard 107. The receiver 105 can be milled and threaded on top to mount the optics rail 190. The receiver 105 can be configured to at least partially house a bolt 128. The trigger assembly 18 can be a metal or composite housing that holds a trigger mechanism 122 (fire control) and magazine 54 in the correct position to interact with the bolt 128. The trigger assembly 18 can also be the attachment point for a grip 124 and butt stock 125. The trigger assembly 18 can also receive a replaceable firing pin bridge 40 (shown in FIGS. 6 and 7).

Figure 3:
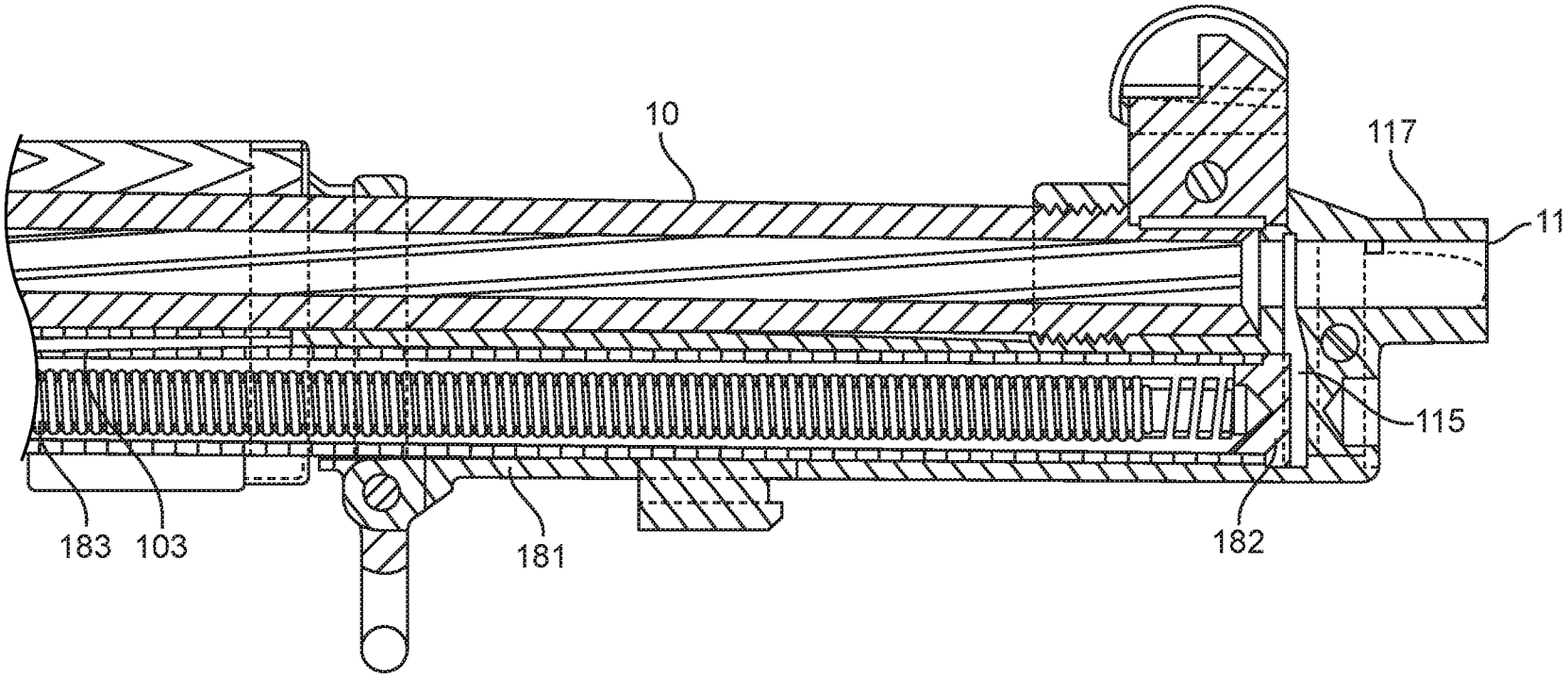
FIG. 3 is a cross-sectional view of an example gas cylinder system.

The operating rod group can include an operating rod 103 with charging handle 104 built in, the gas piston 182 at the end of the operating rod 103, and the biasing element 183 and guide (shown in FIG. 3).

The barrel group 12 includes a barrel 10 and a gas cylinder assembly 114. The barrel 10 can have a muzzle 11 located at a distal end and be coupled to the receiver 103 at the proximal end. The barrel 10 and gas cylinder assembly 114 can be coupled by the gas chamber 116. The barrel 10 can have a gas port 115 formed therein and aligned with the gas chamber 116. The gas port 115 can be located substantially close to the muzzle 11. The gas cylinder assembly 114 can have a gas plug 118 at a distal end. During firing of the rifle 100, a portion of the propulsion gas is bled into the gas port to actuate the gas cylinder assembly 114. In at least one implementation, the barrel 10 and the gas cylinder assembly 114 can be a permanently coupled assembly.

The bolt group 16 can include a bolt 128, a firing pin (not shown), an extractor, an ejector 126 and appropriate springs and plungers for operation (not shown). The necessary springs and plungers for operation along with the firing pin are common to an M14 and/or M1Garand and well known in the art. The semi-automatic rifle 100 utilizes a bolt group 16 similar in construction to the bolt group of the M1 or M14 rifle systems and a bolt group from the M1 or M14 rifle is interchangeable with the appropriately sized bolt group of the semi-automatic rifle 100. In that regard, the semi-automatic rifle 100 utilizes a similarly constructed firing pin, extractor and ejector as the M1 or M14 rifle. In other embodiments, the semi-automatic rifle 100 can utilize any firing pin, extractor and ejector to accommodate various caliber and cartridge sizes and configured for use within the receiver 105 and trigger assembly 18. Additionally, the bolt 128 of the rifle 100 can be manufactured of 8620 steel and can be carburized. The advantage of carburizing the steel used to manufacture the bolt is the increased hardness of the outer surface of the bolt, while the inner core of the bolt retains toughness and ductility. The bolt can also be treated with a nitride treatment as described above.

A hand guard 107 can be disposed around at least a portion of the operating rod 103, thereby protecting the operating rod 103 during operation from foreign matter including user's hands. The hand guard 107 can be a metal or composite unit that mounts to the receiver group to protect the user's hand from heat and movement of the operating. The hand guard 107 substantially covers the exposed portions of the gas-cylinder system. The hand guard 107 can be coupled to the receiver group 14. Further, the hand guard 107 can be configured to attach only to the receiver group 14. In at least one embodiment, the hand guard 107 is coupled to the receiver 105. The hand guard 107 can be constructed of carbon-fiber, aluminum or other similar lightweight materials. The hand guard 107 can additionally incorporate perforations 108 or openings to assist the air-cooling of the barrel 10 and the gas-cylinder system 114. The perforations 108 can assist with air-cooling of the barrel 10 along with reducing the overall weight of the semi-automatic rifle 100 through the removal of material.

In FIG. 1, the perforations 108 are circular. Other perforation shapes 108 can be implemented including, but not limited to, elliptical, vertically slotted, horizontally slotted, or any polygonal shape.

The hand guard 107 can have at least one accessory rail 110 formed thereon to receive monopods, bipods, lights, optics, laser designators, fore grips, and other similar accessories known in the art. In at least one embodiment, the accessory rail 110 can be a picatinny rail. As can be appreciated in FIG. 1, the hand guard 107 includes four accessory rails 110, 111, 112 disposed on each side of the hand guard 107. The fourth accessory rail is not visible in FIG. 1, but is disposed on the sidewall opposite accessory rail 111.

In at least one embodiment, the at least one accessory rail 110 is coupled to the barrel group 12. These accessory rails 110, 111, 112 can be at positions corresponding to at least one of the 12 o'clock, 3 o'clock, 6 o'clock or 9 o'clock positions about the barrel group 12. In other embodiments, the accessory rails 110, 111, 112 can be position approximately 90 degrees apart one from the other. The semi-automatic rifle 100 has a top rail 110 and a bottom rail 112 disposed approximately 180 degrees apart and two side accessory rails 111 disposed approximately 180 degrees apart, such that no two accessory rails 110, 111, 112 are more than approximately 90 degrees apart. One or more of the accessory rails 110, 111,112 can be coupled to the hand guard 107, the barrel 10, the receiver 105 or a combination thereof. The accessory rails 110, 111, 112 can be manufactured by a milling process.

The semi-automatic rifle 100 can utilize a bolt 128 common to the M1 Garand of the above identified patent. The bolt 128 can be coupled to the operating rod 103. As the rifle 100 is fired, the bolt 128 and the operating rod 103 cooperate to automatically reload the weapon. The operating rod 103 can include a biased operating rod guide and a biasing member (shown in FIG. 8) to allow proper operation of the rifle 100. In at least one embodiment, the biasing member can be a coil spring configured to bias the operating rod toward the muzzle 11.

The bolt 128 can have one or more protrusions (not shown) that are received in a lug pocket 106 of the operating rod 103. When the rifle 100 is discharged, the propulsion gas forces the operating rod 103 to move within the receiver 105, thereby actuating the bolt 128.

The trigger assembly 18 can include a trigger group 120, a magazine group 22, a grip 124, and a butt stock 125. The trigger group 20 can be configured to interact with the firing pin (not shown) and bolt 128 to fire a round from a cartridge recessed in the chamber. The trigger group 20 can include a trigger 122 configured to actuate a hammer 176. When the rifle 100 is in battery, actuation of the trigger 122 can actuate the hammer 176 thereby discharging the rifle.

The magazine group 22 can include a magazine well 120 and a magazine 54. The magazine well 120 can be disposed at the front portion of the trigger assembly 18 to provide access to the bolt 128 and breech of the barrel 10. The magazine well 120 can be a magazine receiving portion configured to receive a magazine 54. The magazine 54 can receive a plurality of cartridges and be aligned by the magazine well 120 to introduce a cartridge into the receiver 105.

The trigger assembly 18 can be attached to the receiver 105 by two pins that serve to locate the trigger assembly 18 relative to the receiver 105 such that, the magazine 54 is in proper position in relation to the bolt 128 and breech of the barrel 10. The new firing pin bridge 40 (shown in FIG. 6) is also pinned into this trigger assembly 18 to maintain a function of preventing out of battery discharge by blocking movement of the hammer 176. The trigger assembly 18 can also hold and locate the trigger mechanism 122 of the rifle 100. The use of a COTS trigger group 20 components can enable use of custom and precision triggers available for modern weaponry with an implementation of the semi-automatic rifle 100. The trigger assembly 18 also is the attachment point for a pistol grip 124 and butt stock 125. The trigger assembly 18 also allows the use off the shelf magazines for various calibers. Also unique for a rifle of this type, the design of the magazine well housing also brings the stock in line with the bore of the rifle to reduce felt recoil and eliminate muzzle rise on rapid firing of the rifle.

Figure 2:
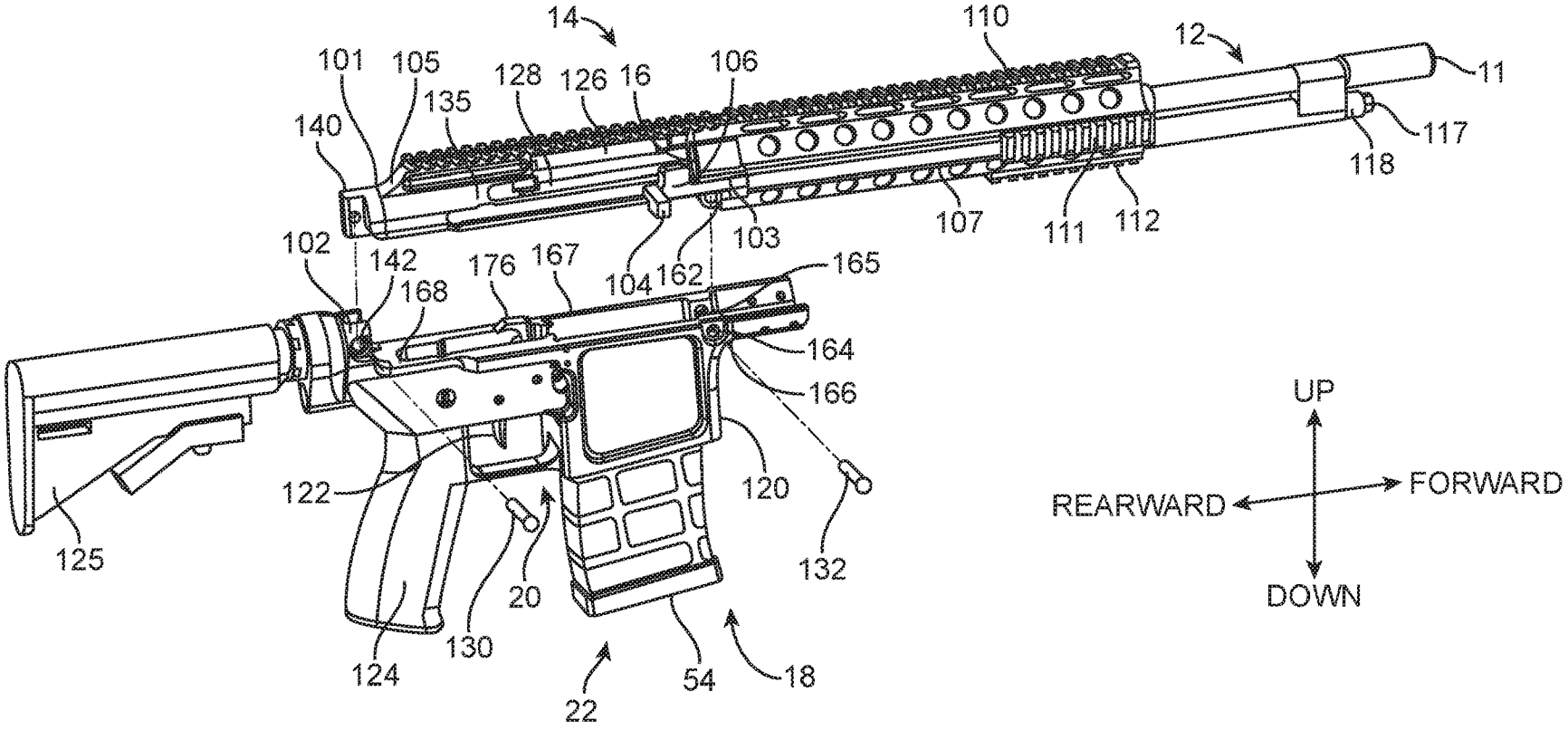
FIG. 2 is a partially exploded view of the semi-automatic rifle of FIG. 1.

FIG. 2 illustrates a semi-automatic rifle 100 of the present disclosure in a partially exploded view. The receiver 105, barrel group 12 and bolt group 16 in this embodiment can be coupled to the trigger assembly 18 by a pair of pins 130, 132 that are received by pin receiving apertures 142, 164 in the trigger assembly 18 and receiver 105. The receiver 105 can have a first trigger assembly attachment portion 162 and a second trigger assembly attachment portion 140 to absorb the recoil generated by firing the rifle 100. The second trigger assembly attachment portion 140 can be substantially aligned with the butt stock 125 and transfer energy and inertia into the butt stock 125. The first trigger assembly attachment portion 162 can absorb recoil while also preventing the receiver 105 and barrel group 12 from raising upon firing of the rifle 100.

The first trigger assembly attachment portion 162 can be received in a first receiver attachment portion 165. The second trigger assembly attachment portion 140 can be received in second receiver attachment portion 102 (shown in FIG. 1).

In at least one embodiment, the first trigger assembly attachment portion 162 can be a front recoil lug and the first receiver attachment portion 165 can be a front recoil lug pocket. The front recoil lug and front recoil lug pocket can be coupled by a pin 132. The pin 132 can be inserted through aligned apertures formed in the front recoil lug and the rear lug pocket, thereby coupling the receiver 105 and the trigger assembly 18. The second trigger assembly attachment portion 140 can be coupled to the second receiver attachment portion 102 in substantially the same way with a pin 130 inserted through aligned apertures formed in a front recoil lug and a front recoil lug pocket.

In at least one embodiment, the barrel 10 can be manufactured of ordinance steel or similar material or can be manufactured of 4150 chrome moly-vanadium steel or other suitable material or combinations thereof. The barrel 10 can be heat treated during manufacture using one of several commonly known processes, such as a salt-bath heat treatment. Additionally, the barrel can be treated with a nitride treatment during manufacture to provide the surfaces of the barrel with additional corrosion resistance and to ease in the cleaning of the barrel and reduce the need for lubrication, which has the tendency to attract dirt, sand or carbon deposits. The barrel 10 can also be rifled. In at least one embodiment, the rifling of the barrel can be created through button rifling. The twist rate of the rifling can be adapted to correspond to the particular caliber and load utilized for a particular semi-automatic rifle 100.

The barrel of the present disclosure is of the "free floating" variety. A free floating barrel does not contract with the stock group. In the semi-automatic rifle 100, the barrel group 12 is not directly coupled to the stock group, but instead is coupled to the receiver group 14. In at least one embodiment, the barrel group 12 is coupled to the receiver 105.

FIG. 3 illustrates in more detail the gas-cylinder system of the present disclosure. The gas-cylinder system of the present disclosure is of the long-stroke piston variety and similar to the gas-cylinder system employed in the M1 Garand rifle and other rifles. One advantage of using a long-stroke piston configuration is the elimination for the need for a buffer system housed in the stock and guides on the barrel. This permits the use of folding or collapsible stocks, and permits relatively longer barrels. As a result, the semi-automatic rifle 100 of the present disclosure can have relatively increased accuracy while keeping the overall dimensions of the rifle lower.

The gas cylinder system 114 can be coupled to the lower portion of the rifled barrel 10, but other configurations are possible such as above the barrel 10 and on a side of the barrel 10. The gas cylinder system 114 is coupled to a gas port 115 in the barrel 10 and the gas port 115 can be located near the muzzle 11 on the forward portion, or distal portion from the view point of an operator, of the barrel 10. For example, the gas port 115 can be located with 2 cm to 10 cm from the muzzle. In at least one embodiment, the gas port 115 is within 4 cm of the muzzle 11.

In at least one embodiment, the gas-cylinder system 114 includes a gas port 115, a substantially hollow gas cylinder 181, a piston 182, an operating rod 103 and a biasing element 183. In at least one embodiment, the gas-cylinder system 114 can be manufactured of ordinance steel or other suitable material. The gas-cylinder system 114 can also be heat treated and/or can be treated with a nitride treatment as described above.

The piston 182 can be coupled to the operating rod 103 proximate to the muzzle facing end of the operating rod 103. The operating rod 103 can be manufactured of 4130 steel or other suitable materials, and can also be treated with a nitride treatment as described above. The biasing element 183 can comprise a spring and serves to bias the operating rod 103 and the piston 182 in the direction of the muzzle along the gas cylinder 181. The biasing element 183 can be housed within the operating rod 103. The operating rod 103 can further comprise a handle 104. In at least one embodiment, the handle 104 can be located on the right hand side of the operating rod 103, as viewed from an operator of the rifle 100. As can be appreciated in FIGS. 1 and 2, the handle 104 can be a protrusion extending substantially perpendicular to the length of the operating rod 103. The handle 104 can be flat or have a curved shape to improve the ergonomics.

When the rifle 100 is discharged, hot gas created by the ignition of the powder load from the cartridge expands to force the round down the barrel 10. When the round passes the gas port 115, the hot gas is able to expand into the gas cylinder 181. As the gas expands into the gas cylinder 181, the pressure created by the expanding gas presses against the piston 182 causing the piston 182 and the operating rod 103 to move rearwardly towards the bolt 128. The motion of the operating rod 103 causes the bolt 128 to move rearwardly, which in turn causes the cartridge casing to be expelled from the receiver group 14 through ejection port 126. Further rearward motion of the operating rod 103 causes the bolt 128 to move further rearward such that a new cartridge is able to be seated in the chamber, the trigger group 20 reset, and compresses a bolt biasing element, such as a spring. Once the pressure from the hot gas subsides as it cools and escapes from the muzzle, the biasing element will push the operating rod 103 forward, which causes the bolt 128 to move forward locking the new cartridge into place in the chamber in preparation for firing. Finally, the operating rod 103 and piston 182 are returned to their starting position by way of the piston biasing element or spring.

As shown in FIG. 3, the gas port 115 is positioned near the muzzle 11 of the barrel 10. In at least one embodiment, the gas port 115 in the barrel 10 is located approximately 1.5 inches from the muzzle. The advantage of this location is that the piston is not actuated by expanding gas from discharge until the projectile has cleared the muzzle 11, enhancing the accuracy of the rifle and improving its reliability.

The gas cylinder system 114 can be permanently or detachably coupled to the barrel. In at least one embodiment, the gas cylinder system 114 is permanently coupled to the barrel through welding or other well-known techniques. When the gas cylinder is permanently coupled to the barrel, the system is strengthened and life of the system can be extended. In other embodiments, the gas cylinder is removably coupled to the barrel 10 and a gas cylinder lock can be included.

Figure 4:
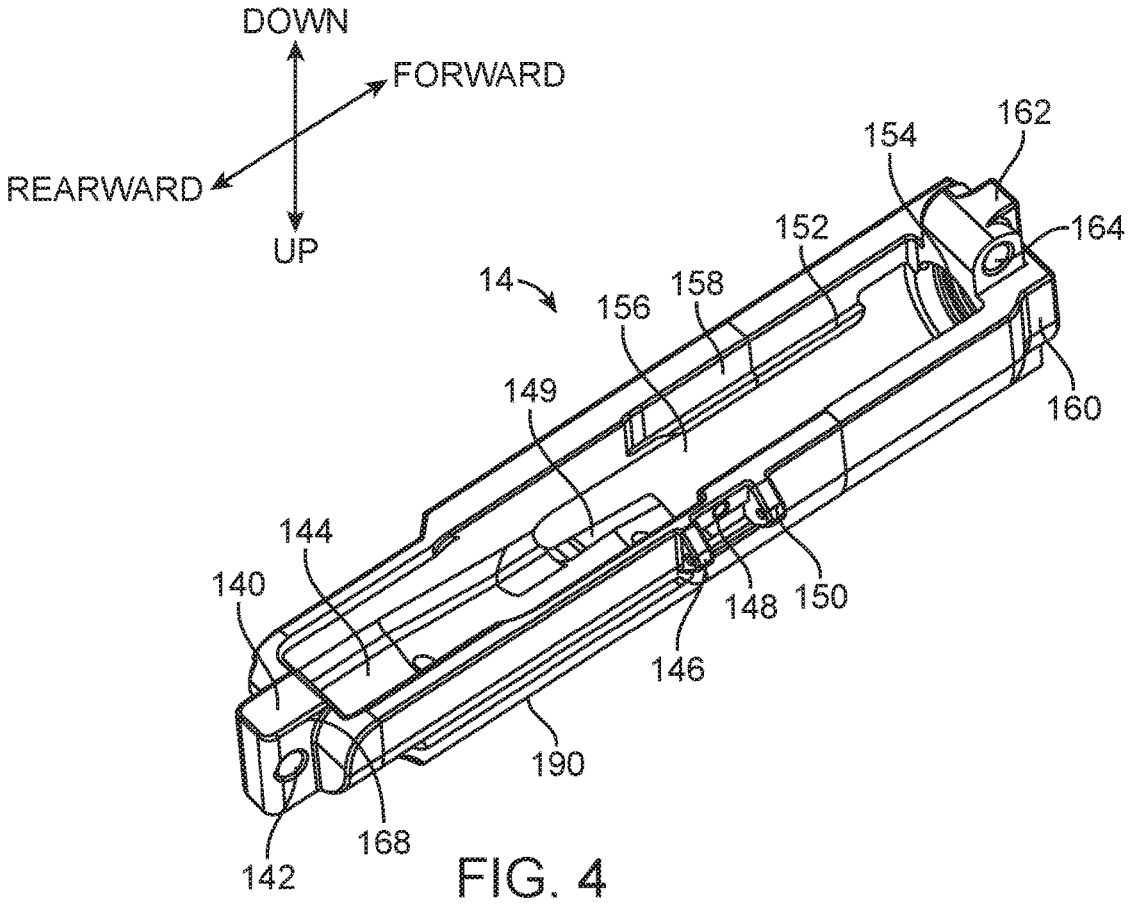
FIG. 4 is a bottom perspective view of a receiver group the semi-automatic rifle of FIG. 1.

The gas cylinder system 114 can further comprise gas plug 118. The gas plug 118 provides some of the volume of the gas cylinder. The gas plug 118 can also be removable from the gas cylinder 181 and coupled to the gas cylinder 181 by a threaded connection 117. In at least one embodiment, the threaded connection 117 is nut arranged on a threaded protrusion. In other embodiments, the threaded connection 117 can be a hex key arrangement to engage the gas cylinder 181. The hex key arrangement can provide a substantially flush exterior surface of the gas plug 118. The volume of the gas plug 118 can be configured and adapted for different calibers and loads or suppressed fire to ensure appropriate operation of the gas cylinder system 114. The gas plug 118 can accommodate inserting and removing a piston 182 at least partially located in the gas cylinder 181. Thus, the piston 182 and the gas cylinder 181 can also be serviced FIG. 4 illustrates the receiver 105 of the receiver group 14 as viewed from below. The bolt group 16 is configured and adapted to slidably translate and rotate within a bolt receiving space 156 formed by the receiver 105. The interior of the receiver 105 according to an embodiment is simplified to reduce the amount of cores needed in a casting die, or machine operations needed if the part were machined from billet or forgings. The receiver 105 can reduce manufacturing time by 25 to 50 percent due to reduction in production labor time.

Figure 5:
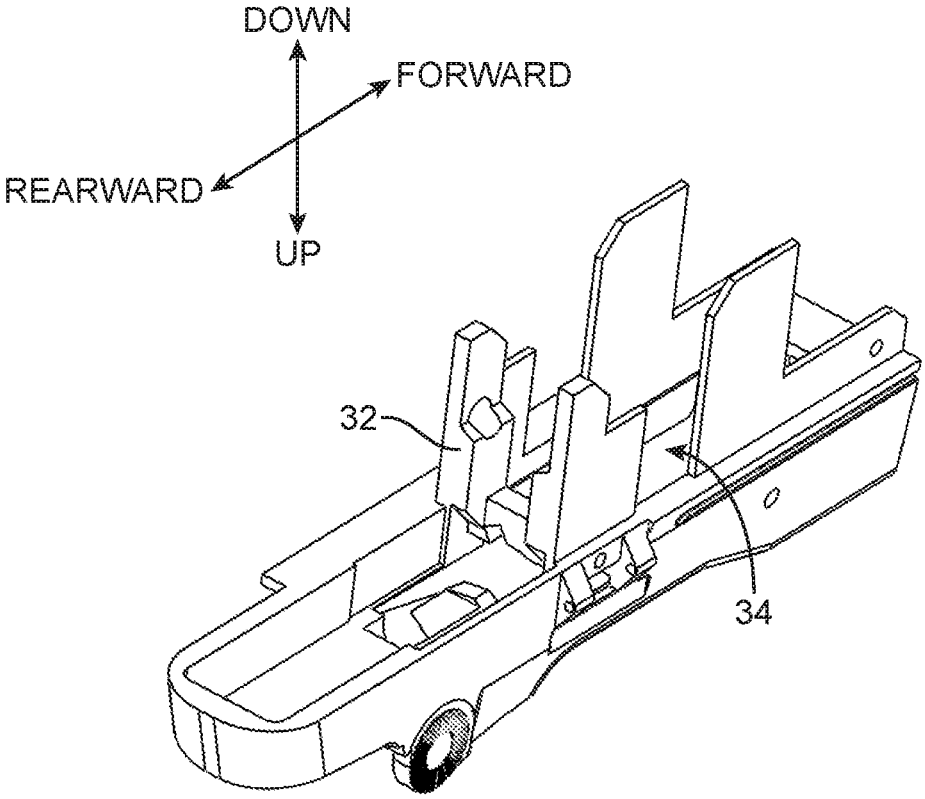
FIG. 5 (PRIOR ART)
FIG. 5 is a bottom perspective view of the of a prior art receiver group of an M1 rifle.

The receiver 105 is serialized providing information about the manufacture of the rifle 100, such as a serial number. The configuration of the receiver 105 is more streamlined as compared to the receiver of the prior art, as illustrated in FIG. 5. Specifically, the receiver 105 of the present disclosure is "legless" and the safety bridge 40 has been removed repositioned into the trigger assembly 18. The receiver 105 is configured and adapted to provide a recess that cooperates with a recess in the trigger assembly 18 to create a bolt receiving space 156. The bolt receiving space 156 created permits the bolt group 16 to slidably translate and rotate within the bolt receiving space 156 while also providing cam surfaces that cause the bolt group 16 to rotate into and out of alignment. This translating and rotating action locks a subsequent cartridge into place, unlocks a discharged cartridge casing and causes it to be expelled through the ejection port 126 of the receiver 105 (shown in FIGS. 1-2).

As can be appreciated in FIG. 4, the receiver 105 can include a guide track 144 and a clearance cut 149 for the bolt 128 (shown in FIGS. 1-2). The guide track 144 can allow the bolt 128 to track properly within the receiver 105 during firing and loading of the rifle 100. The guide track 144 can be a groove formed in the inner sidewall of the receiver 105. The clearance cut 149 can allow the protrusions extending from the bolt 128 to actuate during operating of the rifle 100.

The receiver 105 can also include a magazine stop 152 to properly guide the magazine 54 to the proper alignment within the receiver 105. The magazine stop 152 can be ridge extending from the inner sidewall of the receiver 105 to prevent the magazine 54 from being inserted further into the receiver 105. The magazine stop 152 can engage the sidewall of the magazine 54 to properly align the magazine 54 with the barrel 10 and bolt 128 for operation of the rifle 100.

The receiver 105 can further include bolt stop ears 146, 150 and a spring bias 148. The bolt stop ears 146, 150 and the spring bias 148 can work collectively to stop the bolt 128 and operating rod 103 in the open position upon discharge of the last round in a magazine 54.

The receiver 105 can be threaded 54 at a front end 160 for rotational attachment to the barrel group 12. Additionally, the receiver 105 includes at least one optics rail 190. The optical sights can be mounted to the optical rail 190 of the receiver 105 by way of lugs, which can be recessed into the receiver 105. Additionally, the lugs 192 can be configured and adapted such that the lugs 192 bear the load of the optical sights and screws are used to secure the optical sights vertically to the receiver 105. Optical sights can be mounted in a flat configuration or in a sloped configuration depending on the range that the operator desires to sight.

In at least one embodiment, the receiver 105 can be manufactured of finished 17-4 (or other similar suitable materials) stainless steel through one of a variety of well-known manufacturing processes. The receiver 105 can be hammer forged, machined from a billet, investment cast or manufactured from an additive manufacturing process. The receiver 105 can be hardened by way of a precipitation hardening process or other commonly acceptable practices depending on the material used, to the hardness needed to attain the desired strength and wear performance for the part. In at least one embodiment, the hardening of the receiver 105 can be to approximately 40 to 42 Rockwell C hardness. In at least one embodiment, the receiver 105 can further be treated with a nitride treatment, as described above.

Figure 6:
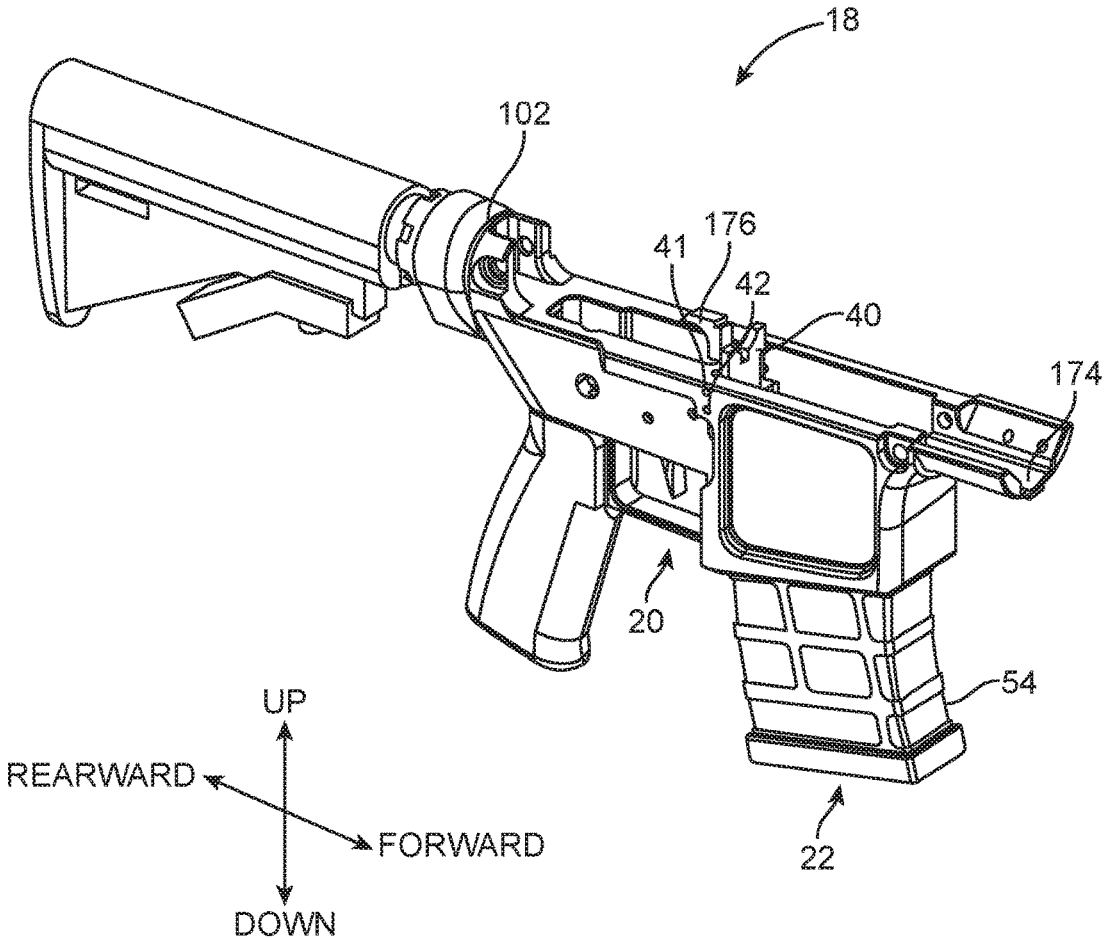
FIG. 6 is a perspective view of a trigger assembly of the semi-automatic rifle of FIG. 1.

FIG. 6 illustrates the trigger assembly 18 of the semi-automatic rifle 100. The trigger assembly 18 is not serialized. The trigger assembly 18 can be manufactured to be "legless" in the same manner as the receiver 105. The safety bridge 40 can be configured to be appropriately sized to correspond to the caliber of the rifle. The trigger assembly 18 can be manufactured bridgeless, such that the safety bridge 40 can be removably coupled to the trigger assembly.

The firing pin bridge 40 can be separately formed and can be configured to be removable. The removable pin bridge 40 simplifies manufacture of the receiver 105 and trigger assembly 18 while allowing the pin bridge to be replaced.

The trigger assembly 18 can also include an operating rod spring guide track 174. The operating rod spring guide track 174 can receive the operating rod spring guide (shown in FIG. 8) into the trigger assembly 18 and ensure proper movement of the operating rod spring guide during firing of the rifle 100.

The trigger assembly 18 further includes the magazine well 120. The magazine well is appropriately configured and adapted to receive standard magazines corresponding to the caliber of the rifle 100. Accordingly, the magazine well 120 can be configured and adapted to accommodate magazines of a desired size. The magazines can be locked into place and released using a magazine release system.

Further, the magazine well 120 can be removably coupled to the trigger assembly 18. The magazine well 120 can be removably coupled by way of pins receivable within corresponding pinholes. The removable magazine well 120 allows for greater standardization in manufacturing. The magazine well 120 can be manufactured from carbon-fiber, aluminum or other similar lightweight materials. The butt stock 125 can also be configured and adapted to couple to the magazine well.

The trigger assembly 18 also houses the trigger group 20. In at least one embodiment, the trigger group 20 of the semi-automatic rifle 100 is of the AR15/M16 variety. The trigger mechanism of the trigger group 20 can be of the precision trigger variety. The grip 124 of the semi-automatic rifle 100 can be a pistol-type grip. Further, the grip 124 can be coupled to the magazine well 120 of trigger assembly 18.

Figure 7:
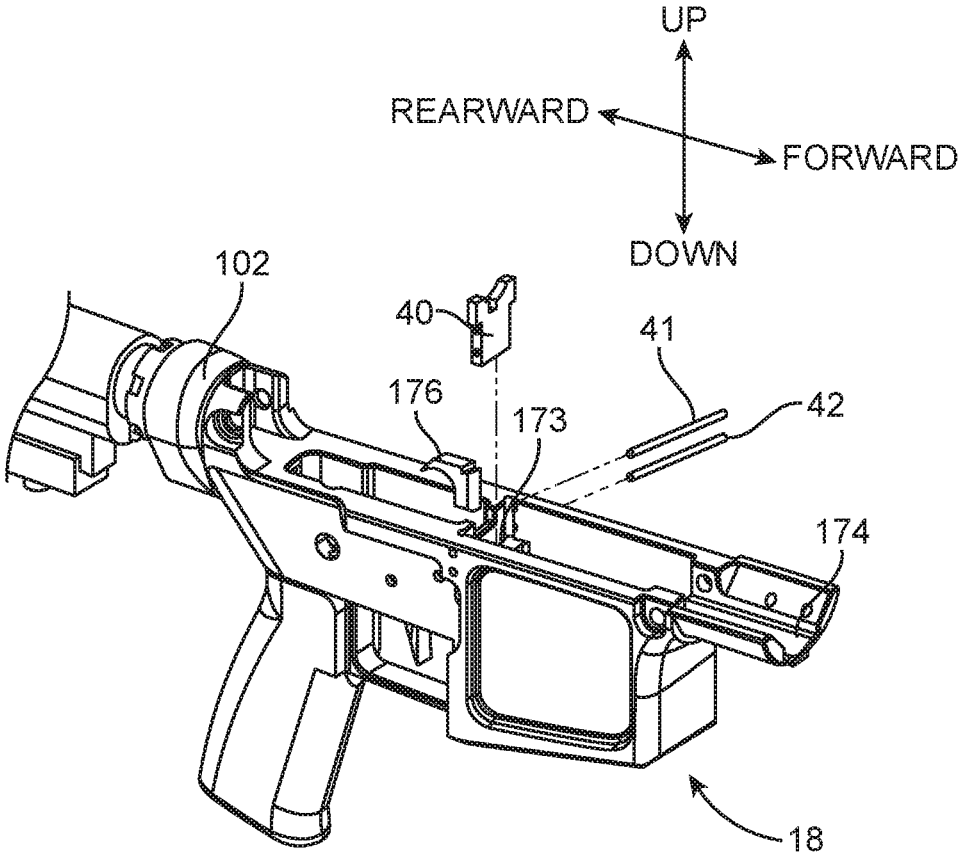
FIG. 7 is an enlarged partially exploded view of the trigger assembly of FIG. 6.

FIG. 7 illustrates a partially exploded view of a trigger assembly of an example embodiment of a semi-automatic rifle. As illustrated in FIGS. 5 and 6, the removable safety bridge 40 can be coupled to the trigger assembly 18 by way of pins 41, 42 or other similar removable attachments. The advantage of this removable bridge 40, which is subject to significant wear, can be easily replaced and cheaply manufactured thus extending the useful life of the trigger assembly 18. Further, the manufacturing of the trigger assembly 18 and bridge 40 are greatly reduced.

The butt stock 125 of the semi-automatic rifle 100 can be removably coupled to the trigger assembly 18. The coupling of the butt stock 125 to the trigger assembly 18 can be configured such that the stock is in line with the bore of the barrel thereby enhancing the accuracy of the rifle. In at least one embodiment, the butt stock 125 can be any COTS butt stock configured for use on an AR-15 platform including, but not limited to, collapsible stocks and folding stocks.

The stock 125 can be made of carbon fiber, wood, aluminum or other similar light-weight materials. Additionally, the stock can be of the folding or collapsing varieties because the semi-automatic rifle 100 does not require a buffer or buffer tube. Accordingly, when a folding or collapsible stock is put in the folded or collapsed position, respectively, the overall length of the semi-automatic rifle 100 can be relatively short, while maintaining a significant barrel length. This configuration allows a higher muzzle velocity of the rounds fired, thus the rifle is more accurate than shorter barrel configurations.

Figure 8:
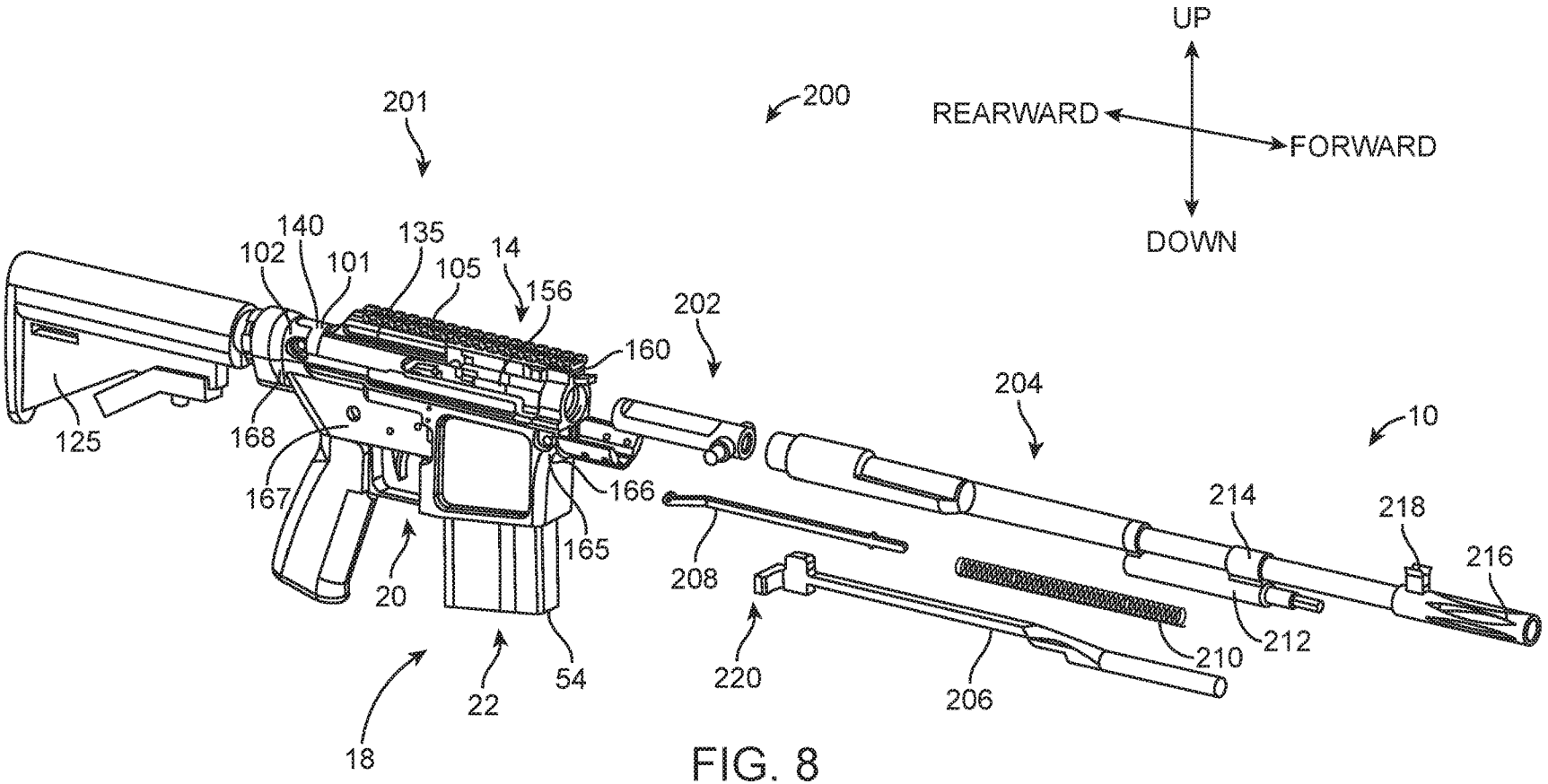
FIG. 8 is an exploded view of a retrofit kit for a semi-automatic rifle according to an embodiment of the present disclosure.

FIG. 8 illustrates an exploded view of a retrofit kit for a semi-automatic rifle. A semi-automatic rifle 200 can include a retrofit 201 configured to reuse a barrel group 204, bolt 202, and gas cylinder 214. The retrofit kit 201 can include a receiver 105 configured to be coupled to the barrel group 204. A trigger assembly 18 can be configured to be coupled to the receiver and include a firing pin safety bridge 40 (shown in FIGS. 6 and 7). The receiver 105 and trigger assembly 18 can collectively form a bolt receiving space 156 therebetween configured to accommodate the bolt 202.

The barrel group 204 can be from an existing semi-automatic rifle, or the barrel group 204 can be from an existing replacement barrel for a different model of gun. For example, the existing rifle could be a M14 or the Losok Valkyr. The barrel group 204 can be coupled to the retrofit kit 201, thereby forming a semi-automatic rifle 200. The barrel group 204 can include a barrel 213 having a muzzle 216 and a front sight 218.

In at least one embodiment, the barrel group 204 and bolt 202 can be identical or substantially similar to the barrel group 12 implement in the semi-automatic rifle 100 of FIGS. 1-7. In other embodiments, the barrel group 204 or bolt can be any barrel or configured to operate with the receiver 105 and trigger assembly 18.

The bolt 202 can have outwardly facing protrusion 203 extending from an exterior surface. The protrusion 203 can be received in a receiving portion 207 of an operating rod 206, thereby coupling the bolt 202 with the operating rod 206. The operating rod 206 can also include a handle 220 configured to actuate the operating rod 206. As can be appreciated in FIG. 8, the handle 220 is an outwardly extending protrusion. In other embodiments, the handle 220 can be curved to increase the ergonomics during operating of the semi-automatic rifle 200. The actuation of the operating rod 206, either by the handle 220 or by firing of the semi-automatic rifle 200, can actuate the bolt 202 within the bolt receiving space 156.

As can be appreciated in FIG. 8, the operating rod 206 can also be coupled to an operating rod spring guide 208. A spring 210 can be interposed between the operating rod 206 and the operating rod spring guide 208. The spring 210 can bias the operating rod 206 toward the muzzle 216. While the illustrated embodiment is discussed with respect to a spring guide and spring, the operating rod 206 can be coupled to an operating rod guide biased by any biasing element known in the art including, but not limited to, a spring.

Figure 9:
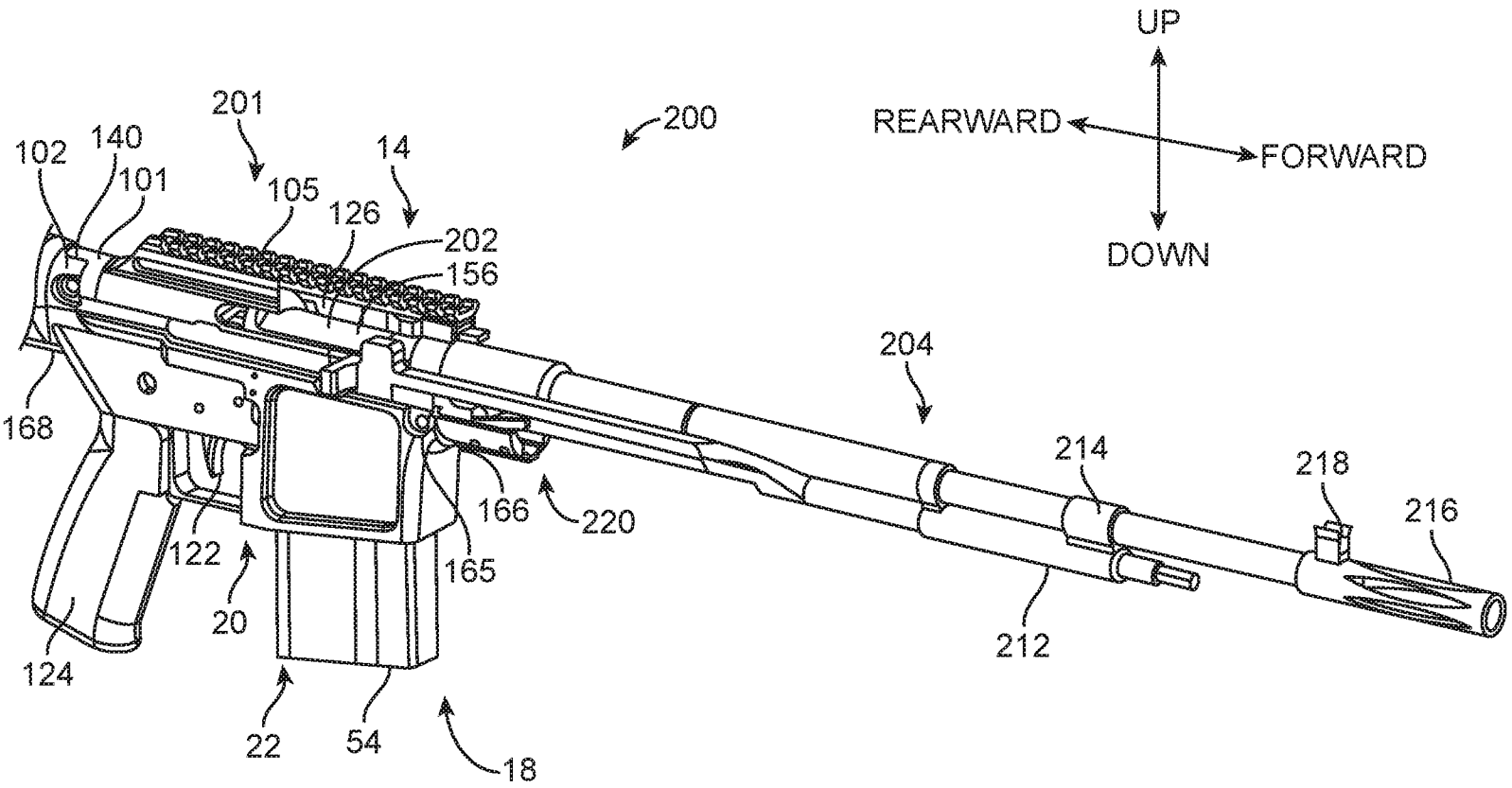
FIG. 9 is a perspective view of a retrofit kit for a semi-automatic rifle.

FIG. 9 illustrates a perspective view of a retrofit kit for a semi-automatic rifle. The trigger assembly 18 of the retrofit kit 201 can include a trigger group 20. The trigger group 20 can include a trigger 122, a hammer 176 (shown in FIG. 6), and related springs necessary for operation. The trigger assembly 18 can also include a grip 124. In at least one embodiment, the grip 124 can be a pistol grip.

As can be appreciated in FIG. 9, the retrofit kit 201 is coupled to barrel group 204 and the bolt 202 is received within the bolt receiving space 156 formed by the coupling of the receiver 105 and the trigger assembly 18. The bolt receiving space 156 can longitudinally extend in the direction of the muzzle 216 allowing the bolt 202 to translate within the bolt receiving space 156 during firing of the rifle 200. The receiver 105 can have an ejection portion 126 formed therein and configured to permit a spent cartridge (not shown) to be ejected. The ejection portion 126 can be at least a portion of the bolt receiving portion 156 sufficient to eject the spent cartridge. The bolt 202, as shown in FIG. 9, is in battery being substantially flush against the barrel 213 and covering the ejection portion 126.

The barrel group 204 can be coupled to the receiver 105 of the retrofit kit 201. The barrel group 204 can include the gas-cylinder 214. The gas cylinder 214 can include a piston reservoir 212 and a piston (not shown). The barrel 213 can include a gas port (not shown) fluidicly coupling the barrel 213 with the gas cylinder 214. The operating rod 206 can be at least partially received within the piston reservoir 212. In at least one embodiment, the gas cylinder 214 can be permanently coupled to the barrel 213 and the gas cylinder can be from the same barrel 213. In other embodiments, the gas cylinder 214 of the barrel group 204 can be from other rifles, replacement parts, or a combination thereof.

The receiver 105 can have a front end 160, which has a first trigger assembly attachment portion 162 and configured to transfer recoil. A body portion 135 can extend rearward from the front end 160. An opposite end of the body 135 portion from the front end 160 forms a rear end 101 and has a second trigger assembly attachment portion 140, which is configured to transfer recoil.

The trigger assembly 18 can have a front end 166 having a first receiver attachment portion 165 and configured to transfer recoil. A body portion 167 extending rearward from the front end 166. A rear end 168 formed at an opposite end of the body portion 167 from the front end 166 and having a second receiver attachment portion 102, which is configured to transfer recoil. The trigger assembly 18 can also include firing pin safety bridge receiving portion 173 (shown in FIG. 7) configured to receive a removable firing pin safety bridge 40 (shown in FIG. 7).

As can be appreciated in FIG. 9, the first trigger assembly attachment portion 162 and the first receiver attachment portion 165 can be coupled one to the other. The second trigger assembly attachment portion 140 and the second receiver attachment portion 102 can be coupled one to the other. The first trigger assembly attachment portion 162 and the second trigger assembly attachment portion 140 can be protrusions configured to be received into the first receiver attachment portion 165 and the second receiver attachment portion 102 respectively, thereby coupling the receiver 105 with the trigger assembly 18.

In at least one embodiment, the first trigger assembly attachment portion 162 and the second trigger assembly attachment portion 140 are recoil lugs configured to be received in recoil lug pockets formed by the first receiver attachment portion 165 and second receiver attachment portion 102 respectively.

Figure 10:
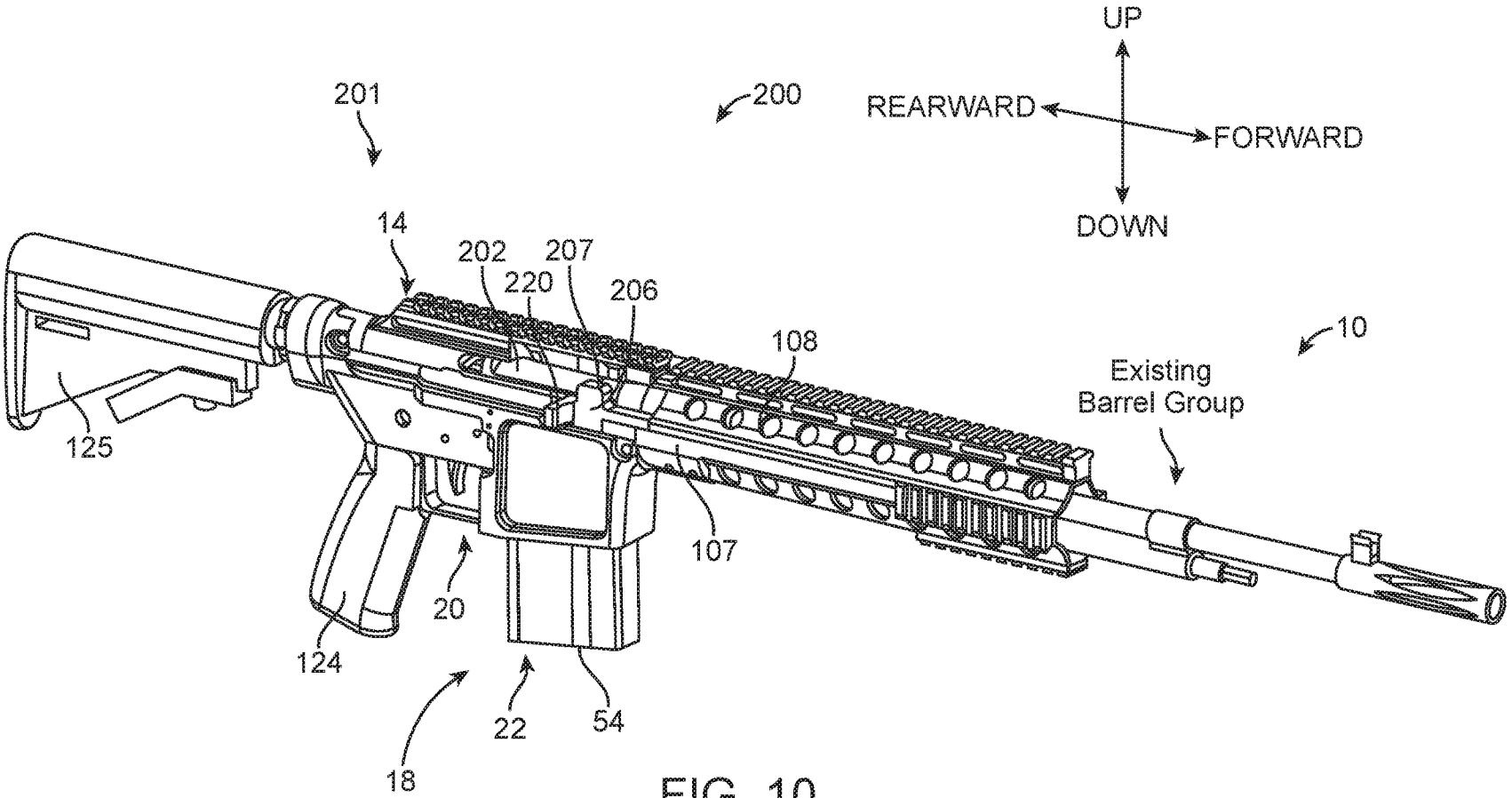
FIG. 10 is a perspective view of a retrofit kid for a semi-automatic rifle.

FIG. 10 illustrates a perspective view of a retrofit kit for a semi-automatic rifle. As can be appreciated in FIG. 10, the retrofit kit 201 can include a hand guard 107. The hand guard 107 can cover at least a portion of the barrel 213 and operating rod 206. In at least one embodiment, the hand guard 107 can cover substantially of the barrel 213 and operating rod 206. The hand guard 107 can be coupled to the receiver 105. In other embodiments, the hand guard 107 can be coupled to the trigger assembly 18. In yet other embodiments, the hand guard 107 can be coupled to the receiver 105 and the trigger assembly 18.

As can be appreciated in FIG. 10, the hand guard 107 vents 108 formed in the exterior surface. The vents 108 can reduce the weight of the hand guard 107 by removing excess material while also improving cooling of the barrel 213. The vents 108 can be of any shape or sizing including, but not limited to, circular, elliptical, or slotted.

Figure 11:
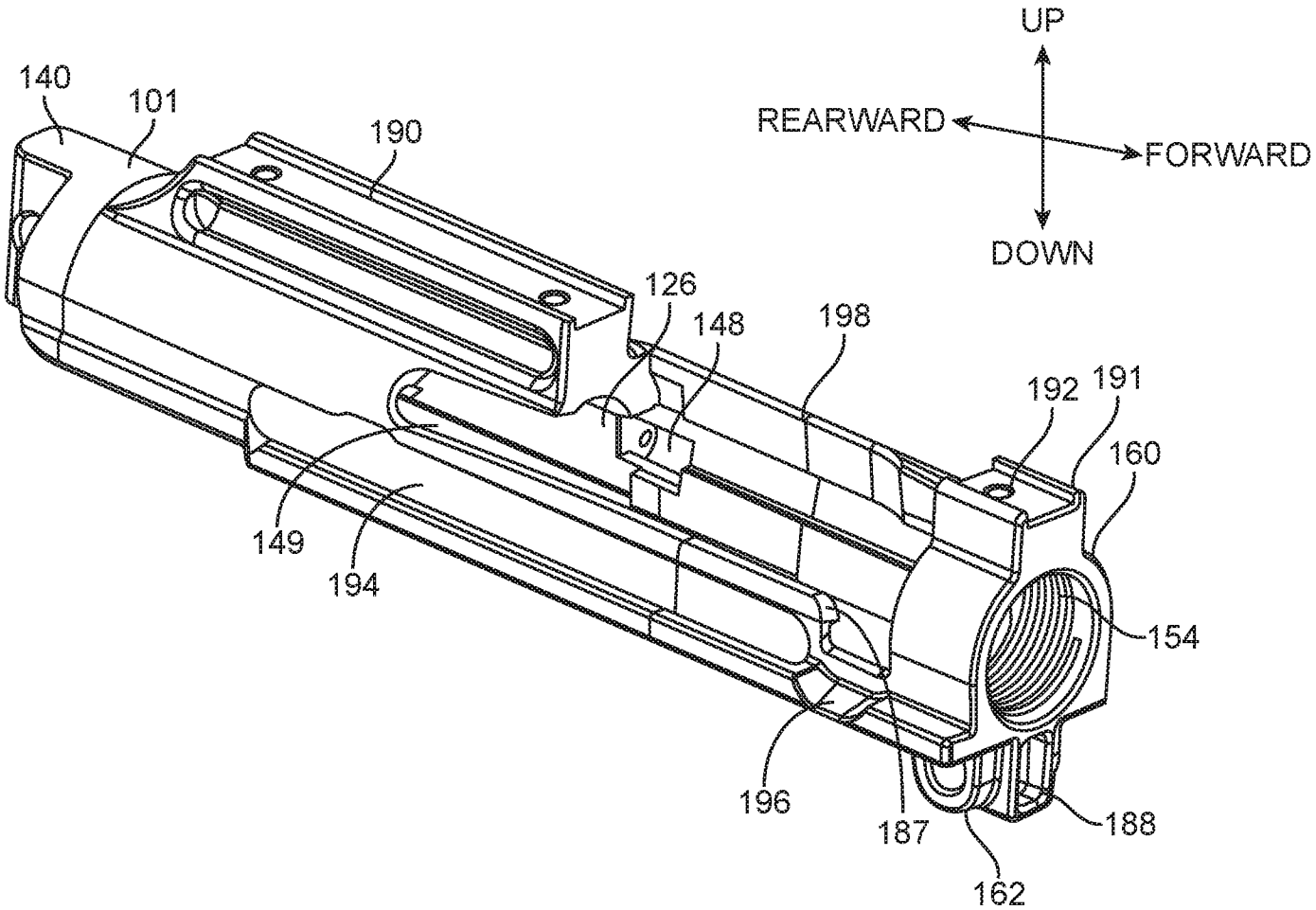
FIG. 11 is a perspective view of a receiver of a retrofit kit for a semi-automatic rifle.
Figure 12:
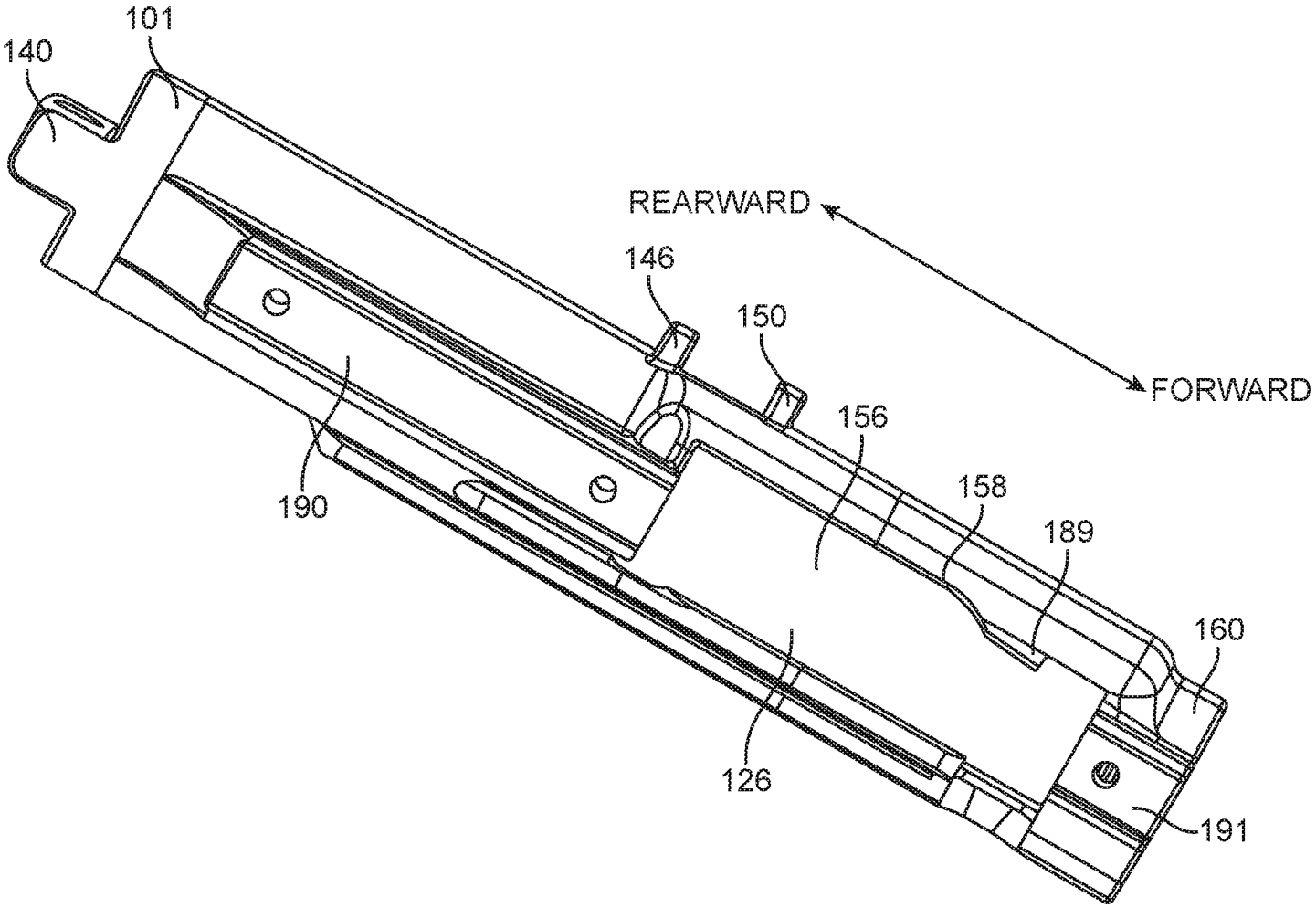
FIG. 12 is a top perspective view of a receiver of a retrofit kit for a semi-automatic rifle.

FIG. 11 illustrates a perspective view of a receiver of a semi-automatic rifle. FIG. 12 illustrates a bottom view of a receiver of a semi-automatic rifle. The receiver 105 illustrated in FIGS. 11 and 12 can be implemented with the semi-automatic rifle 100 of FIGS. 1-7 or the retrofit kit 201 and semi-automatic rifle 200 of FIGS. 8-10.

As can be appreciated in FIG. 11, the receiver 105 has two optics rails 190, 191. The first optic rail 191 can be position in front of the ejection port 126 and the second optic rail 190 can be positioned rearward of the ejection port 126. The first optic rail 191 and the second optic rail 190 can receive optics (not shown) that spans the ejection portion 126. In at least one embodiment, the optics can be a magnifying scope. In other embodiments, the optic can be a red dot, infrared, night vision, or other optics known in the art. The first optic rail 191 and the second optic rail 190 can also have one or more securing points 192. The securing points 192 can allow accessory optics to be securely mounted to the optic rails 190, 191 and prevent movement during operation of the semi-automatic rifle 100, 200 or during transportation.

As can further be appreciated in FIG. 11, the receiver 105 can have a clearance cut 149 for receiving the bolt 202 and protrusions 203 extending therefrom. The receiver 105 can also include a lug pocket 187 for receiving the protrusions 203 extending from the bolt 202 when the rifle 100, 200 is in battery. The exterior surface of the receiver 205 can include an operating rod track 194 to allow proper movement of the operating rod 206 during operation of the rifle 100, 200. A clearance cut 196 can also be provided at the end of the guide track 194 nearest the muzzle 216 to accommodate the bolt 202 when the rifle 100, 200 is in battery. A sidewall 158 of the receiver 105 can include a window 224 for a bolt stop to catch the bolt 202 in an open position when the magazine 54 is empty. The bolt stop catch (not shown) can be coupled to the receiver 105 utilizing ears 146, 150 (shown in FIG. 12).

In at least one embodiment, the first trigger assembly attachment portion 162 can include an operating rod spring guide receiver 188. The operating rod spring guide receiver 188 can be a pocket formed in the first trigger assembly attachment portion 162 and configured to receive the operating rod spring guide 208 when it actuates away from the muzzle 216.

As can be appreciated in FIG. 12, the sidewall 158 of the receiver 105 can include ears 146, 150 to facilitate mounting of the bolt stop (not shown). The bolt stop can be configured to catch the bolt 202 in the open position when the magazine 54 is empty. The receiver 105 sidewall 158 can also include a bolt lug 189 to further facilitate catching the bolt 202 in the open position when the magazine is empty.

From the above description of the disclosure, those skilled in the art will perceive improvements, changes, and modifications in the disclosure. Such improvements, changes, and modifications within the skill of the art are intended to be covered.

What is claimed is:

1. A semi-automatic rifle comprising:

a free floating barrel having a muzzle located at a distal end and an engagement mechanism located at a proximal end, wherein the free floating barrel has a length measured from the proximal end to the distal end;

a receiver configured to be coupled to the engagement mechanism of the free floating barrel;

a bolt configured to be at least partially rotatably mounted relative to the receiver; a gas cylinder system being coupled to the free floating barrel substantially close to the muzzle and comprising an operating rod;

a trigger assembly configured to be coupled to the receiver and receive at least a portion of the operating rod;

a firing pin safety bridge coupled to the trigger assembly; and a fire control located substantially within the trigger assembly and being configured to actuate the bolt so as to eject a cartridge located in a chamber and a subsequent cartridge can be loaded from a clip coupled to the trigger assembly;

wherein the firing pin safety bridge is a removable bridge configured to be coupled to the trigger assembly with at least one pin;

wherein the at least one pin is configured to be inserted through the trigger assembly and the removable bridge to couple the removable bridge to the trigger assembly.

2. The semi-automatic rifle as recited in claim 1, further comprising a hand guard configured to cover substantially all of a length of the gas cylinder system.

3. The semi-automatic rifle as recited in claim 2, wherein the hand guard is configured to be only coupled to the receiver, or to the trigger assembly but not to both.

4. The semi-automatic rifle as recited in claim 2, further comprising at least one accessory rail located at one of a top position, a right side position, a bottom position, or a left side position.

5. The semi-automatic rifle as recited in claim 1, further comprising a gas coupling ring configured to be coupled to the free floating barrel substantially close to the muzzle end and covering one or more gas ports.

6. The semi-automatic rifle as recited in claim 5, wherein the one or more gas ports are located less than four centimeters from the muzzle.

7. The semi-automatic rifle as recited in claim 1, wherein the gas cylinder system is removably coupled to the free floating barrel.

8. The semi-automatic rifle as recited in claim 1, wherein the gas cylinder system further comprises a plug.

9. The semi-automatic rifle as recited in claim 8, wherein the plug is sized based upon a cartridge that the semi-automatic rifle is designed to fire.

10. The semi-automatic rifle as recited in claim 1, wherein the receiver has a pinned connection formed at the breech end and a pinned connection formed at the end opposite to the breech end.

11. The semi-automatic rifle as recited in claim 10, wherein the trigger assembly has a pinned connection formed at two locations to receive a corresponding one of the two pinned connections of the receiver and be removably coupled thereto.

12. The semi-automatic rifle as recited in claim 1, wherein the free floating barrel is at least two hundred-fifty millimeters in length.

13. The semi-automatic rifle as recited in claim 12, weighing between two and four and a half kilograms.

14. The semi-automatic rifle as recited in claim 1, further comprising a stock configured to be folded, collapsed or removed, while the firing control remains able to operate.

15. The semi-automatic rifle as recited in claim 1, wherein the trigger assembly is couplable to a legless receiver.

16. The semi-automatic rifle as recited in claim 1, wherein the receiver has a pocket formed in the front end configured to receive an end of a guide rod.

* * * * *